United States Patent [19]

Dillon

[11] 4,343,222

[45] Aug. 10, 1982

[54] SHELL RELOADING MACHINE

[76] Inventor: Michael J. Dillon, 7021 E. Paradise Dr., Scottsdale, Ariz. 85254

[21] Appl. No.: 197,540

[22] Filed: Oct. 16, 1980

[51] Int. Cl.[3] ..... F42B 33/02

[52] U.S. Cl. ..... 86/27; 86/23; 86/25; 86/29; 86/36; 86/38; 86/43

[58] Field of Search ..... 86/23, 24, 26, 27, 36–38, 86/25, 29, 43

[56] References Cited

U.S. PATENT DOCUMENTS

| | | | |
|---|---|---|---|
| 2,031,850 | 2/1936 | Peterson | 86/27 |
| 3,224,318 | 12/1965 | Bachhuber | 86/38 |
| 3,345,903 | 10/1967 | Purdie | 86/24 X |
| 4,031,804 | 6/1977 | Boschi | 86/27 |
| 4,078,472 | 3/1978 | Simpson | 86/38 X |
| 4,163,410 | 8/1979 | Dillon | 86/23 |
| 4,273,024 | 6/1981 | Veloni | 86/23 X |

*Primary Examiner*—Leland A. Sebastian
*Attorney, Agent, or Firm*—Warren F. B. Lindsley

[57] ABSTRACT

An improved shell reloading machine employing a movable four-position shell plate carried by a single shaft and actuated by a swinging toggle linkage.

7 Claims, 9 Drawing Figures

SHELL RELOADING MACHINE

BACKGROUND OF THE INVENTION

For those who regularly fire rifles or pistols, the cost of ammunition is an expensive consideration. The professional law enforcement agent or avid sportsman may fire a hundred rounds or more of ammunition in a single practice session with the expended raw materials used in addition to its monetary costs inevitably pointing to the need for an appropriate salvage operation to recover and re-use the spent shells.

DESCRIPTION OF THE PRIOR ART

Shell reloading machines have been known for many years. U.S. Pat. No. 2,031,850 describes a progressive reloading machine which simultaneously performs the several functions required in the reloading process. The exploded primer cap is removed, a new primer is inserted, powder is delivered, the end of the shell is enlarged to receive the bullet and a bullet is positioned with each operation of the machine. These several operations take place on a series of shells carried by the machine on a carriage which is manually rotated so as to move each of the several shells carried thereby simultaneously from one station to the next until the complete set of operations have been performed on each shell. A lever is operated to execute the various operations simultaneously on the several shells, so that while one shell is having its exploded primer cap removed, another shell is having a new primer inserted therein, etc. Once an individual shell has completed the sequential steps of the apparatus, it is removed from the carriage and is replaced by another spent shell.

An improved shell reloading machine is described in U.S. Pat. No. 4,163,410 granted to the present inventor. The improved shell reloading machine utilizes a swinging toggle linkage positioned below the tool head and shell carriage and incorporates a swaging operation for the preparation of the primer cavity. An indexing mechanism automatically advances the shell plate after each operation.

While the prior art machines described above afford convenience and significant improvements in the speed of the reloading operation, the equipment is relatively expensive and cost prohibitive for the ordinary sportsman.

What is needed is an improved shell reloading machine that retains as much as possible the utility and convenience of the prior art machines but which at the same time is characterized by a significantly lower initial cost. This goal may be achieved by eliminating those features that contribute more significantly to cost than to utility or convenience and by reimplementing the essential features for reduced equipment costs.

These and other goals and objectives are effectively met in the improved shell reloading machine of the present invention.

SUMMARY OF THE INVENTION

In accordance with the invention claimed, an improved shell reloading machine is provided which incorporates all the essential functions for such a machine.

It is, therefore, one object of this invention to provide an improved machine for reloading shells.

Another object of this invention is to provide a machine which is capable of executing all of the essential operations involved in reloading including those performed by prior art machines such as removal of the exploded primer cap, swaging the primer cap opening, resizing of the shell casing, insertion of a replacement primer, measurement and delivery of the powder charge, expanding and reshaping of the open end to receive the bullet, and positioning of the bullet.

A further object of this invention is to provide a machine in which the several functions are executed progressively wherein a number of shells such as four are processed simultaneously, each experiencing a different functional operation at each stroke of the machine.

A still further object of this invention is to provide such a progressive shell reloading machine in which only one operating stroke is required per reloaded shell.

A still further object of this invention is to provide such a progressive machine in which more than one shell is carried by a moving shell platform, this arrangement being a key to the provision of reduced machine cost.

A still further object of this invention is to provide in combination with such a multi-shell moving platform a swinging toggle drive linkage which offers sufficient mechanical advantage to permit the incorporation of such operations as swaging which are especially demanding in terms of driving force.

Further objects and advantages of the invention will become apparent as the following description proceeds and the features of novelty which characterize the invention will be pointed out with particularity in the claims annexed to and forming a part of this specification.

BRIEF DESCRIPTION OF THE DRAWING

The present invention may be more readily described by reference to the accompanying drawing, in which.

DESCRIPTION OF THE PREFERRED EMBODIMENT

Figure 1:
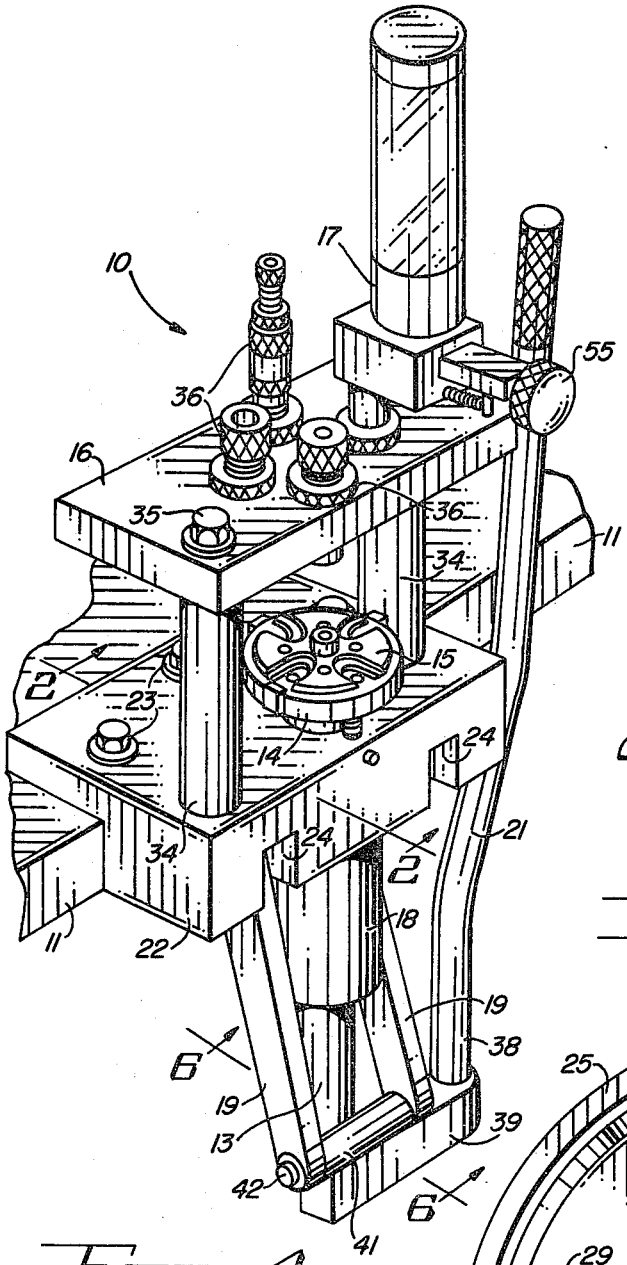
FIG. 1 is a perspective view of the operating portion of the shell reloading machine of the invention.
Figure 2:
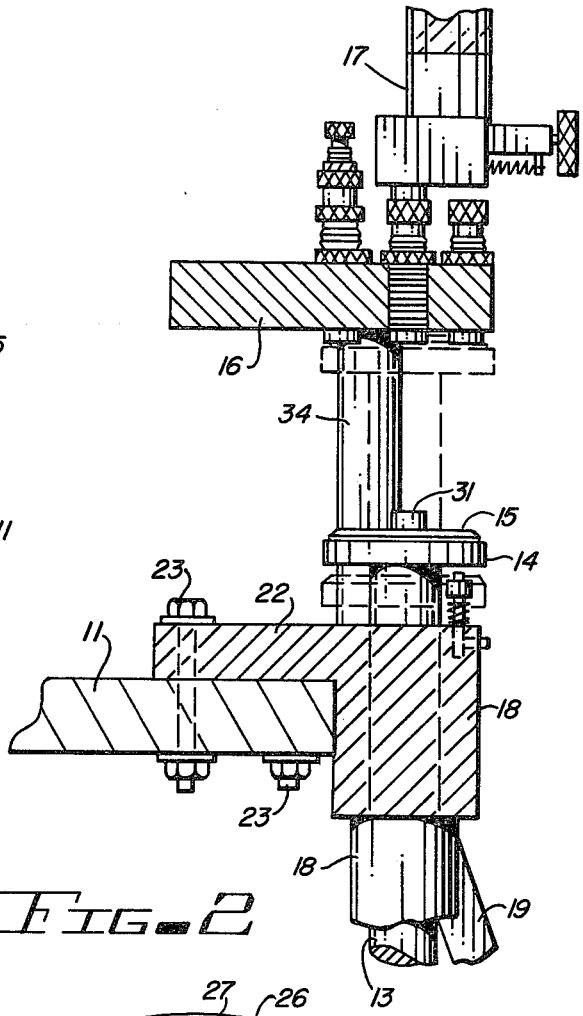
FIG. 2 is a cross-sectional view of the machine, as viewed along line 2—2 of FIG. 1.

Referring more particularly to the drawing by characters of reference, FIGS. 1–7 disclose an improved shell reloading machine 10 comprising a frame 11 and base 12, a piston or drive shaft 13, a moving shell platform 14, a four-position shell plate 15, a stationary tool platform 16, a powder loading magazine 17, a drive cylinder 18, two swinging toggle linkage arms 19 and an operating lever 21.

Figure 7:
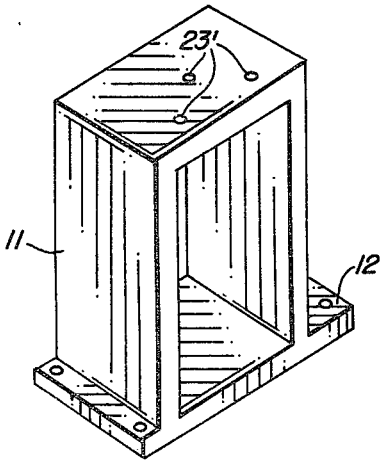
FIG. 7 is a perspective view of the frame for supporting the reloading machine shown in FIG. 1.

The frame 11, as shown in FIG. 7, is in the form of an inverted U, its lower ends being welded to the rectangular base 12. Base 12 is formed to permit it to be secured to a table or bench with frame 11 and base 12 being cast from aluminum, steel or other high-strength material to form a sturdy construction.

The drive cylinder 18 is integral with a rectangular support plate 22 from which it extends perpendicularly. Plate 22 is secured by means of bolts or heavy machine screws 23 to threaded holes 23' in top horizontal member of frame 11 in an orientation such that cylinder 18 extends vertically downwardly along one side of frame 11. Two slots or horizontal grooves 24 are provided in the underside of plate 22 for the pivotal mounting of arms 19.

Shaft 13 fits closely within cylinder 18 but is free to be moved vertically therein. The fit is relatively precise to insure a stable alignment for shaft 13 with other parts of machine 10.

The shell platform 14 is in the form of a circular wafer and is rigidly secured to or integral with the top end of shaft 13. Shaft 13 projects upwardly through the cylindrical opening of cylinder 18. The top surface of platform 14 is flat except that it has a low wall or vertical ridge or projection 25 extending upwardly therefrom at its outer edge. Wall 25 extends all the way around the circular periphery of platform 14 with four openings 26 located at the quadrant positions and cooperates with shell plate 15 in holding the shells. The openings 26 facilitate the removal of the shells at any one of the four processing locations. Gates, barriers or buttons 27 may be slidably positioned in apertures formed in the edges of platform 14 at any of the four openings 26 where it is desired to position the shells under the dies and prevent them from falling out. Different size rims on the shells require different size buttons.

Shell plate 15 is in the form of a flat disc having four slots 29 equally spaced and opening outwardly about its periphery. These slots are specially shaped and undercut to grip the flanged base of the shells which are to be reloaded. Plate 15 is positioned atop platform 14 and is held in a centered position thereon by a thumbscrew 31. Thumbscrew 31 holds plate 15 against the surface of platform 14 but is not so tightly secured as to prevent plate 15 from rotating about its center. The outer edges of plate 15 extend almost to the wall 25. Four circular holes 32 in plate 15 are equally spaced about a circle having a radius a little larger than that of thumbscrew 31. A spring-loaded ball 33 captured within a depression in the surface of platform 14 becomes aligned with one of the four holes 32 when plate 15 is set to one of its four operating positions and thus serves to secure or accurately index the rotational position of plate 15.

Figure 3:
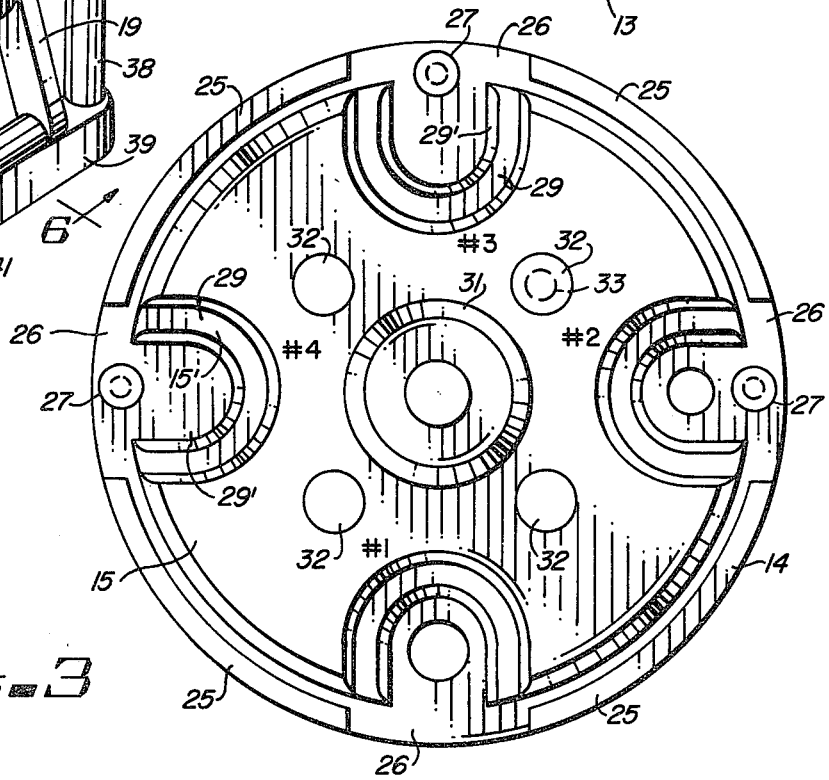
FIG. 3 is a top view of the moving platform and shell plate incorporated in the machine of FIGS. 1 and 2.
Figure 4:
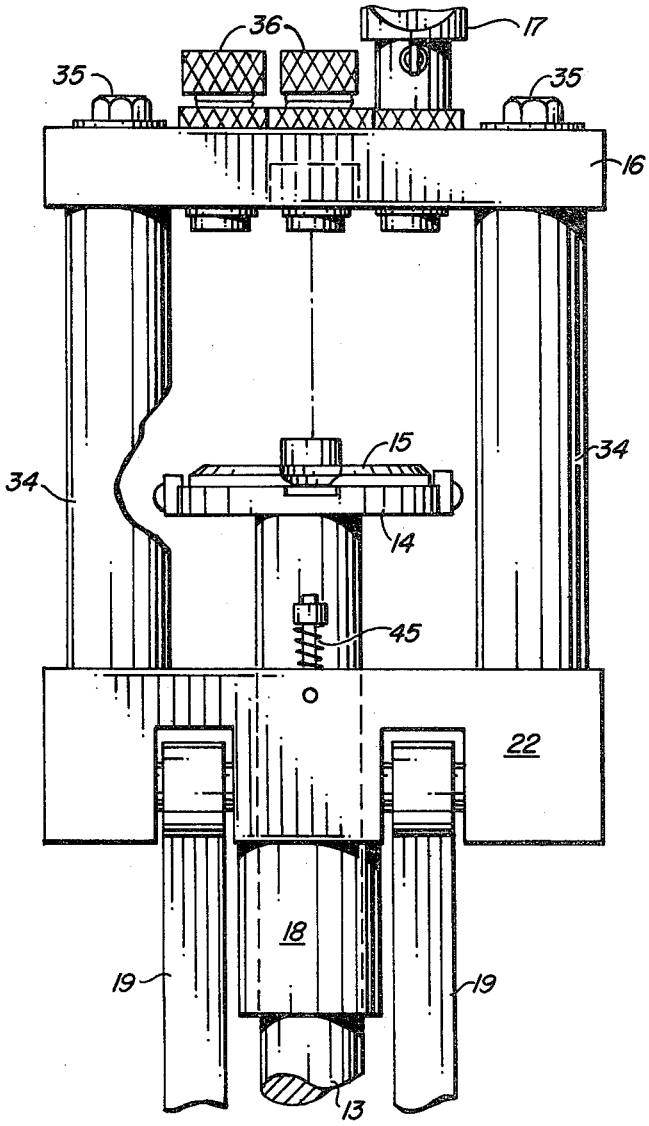
FIG. 4 is an enlarged side view of a portion of the structure of FIGS. 1 and 2.

The illustrations of FIGS. 1 and 3 showing two shell plates 15 and 15' with plate 15 installed over plate 15' is required for use with shells of a particular diameter. The narrower slots 29' of plate 15' are for use with a shell of smaller diameter than the shell for which plate 15 is intended.

The tool platform 16 is spacedly supported in a horizontal position directly above support plate 22 by means of two vertical posts 34 located at opposite sides of plate 22. Machine screws or bolts 35 secure the assembly. The various tools 36 employed in the progressive operations of the reloading process are secured to platform 16 by being turned into threaded holes spaced about a circle in four positions accurately aligned with the corresponding four positions of the indexed shell plate 15.

The swinging toggle linkage arms 19 are elongated strips with pivot holes at each end. The two arms 19 extend downwardly from slots 24 in the underside of plate 22.

Figure 6A:
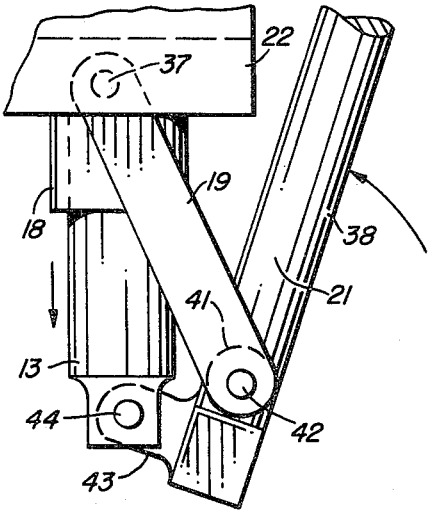
FIGS. 6A and 6B are side views showing two positions of the swinging toggle linkage employed in the machine as seen along line 6—6 of FIG. 1.
Figure 6B:
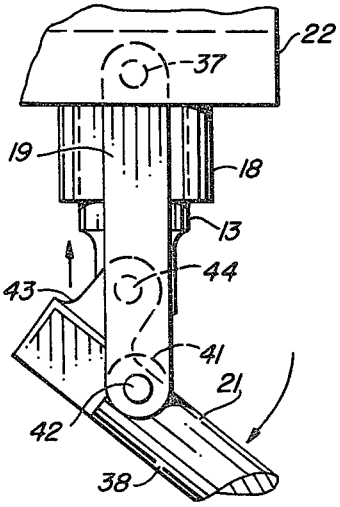

One end of each arm 19 has its upper end extending into slot 24 where it is pivotally secured by a horizontal pivot pin 37, as shown in FIGS. 6A and 6B.

Operating lever 21, as shown most clearly in FIGS. 1, 6A and 6B, comprises a tubular lever arm 38 having a bar 39 extending perpendicularly therefrom at one end thereof. Bar 39 has a square cross-sectional configuration with a top surface thereof facing the direction in which lever arm 38 extends. Longitudinally secured to this surface by welding or other means is a short piece of tubing 41. A pin 42 extending through tubing 41 pivotally secures the lower ends of each of arms 19 through their pivot holes to different ends of tubing 41, as shown.

A tab 43, as shown in FIGS. 6A and 6B, projects perpendicularly from the center of a second face of bar 39. This second face of bar 39 is adjacent the top surface of bar 39 to which tubing 41 is secured such that when bar 39 is drawn in a forward direction in front of shaft 13, as shown in FIGS. 1 and 6A, tab 43 extends into a slot in the lower end of shaft 13 and is pivotally secured therein by means of a pivot pin 44.

Pivot pin 44 is spaced from pin 42 relative to the upper end of lever arm 38. Thus, when arm 38 is moved upwardly about pin 42, as shown in FIGS. 6A, pin 44 moves downwardly carrying shaft 13 toward a lowered position. As arm 38 is moved downwardly, as shown in FIG. 6B, pin 44 moves upwardly carrying shaft 13 toward a raised position. In each case, as arm 38 is pivoted about pin 42, arms 19 swing to the front or to the rear of the structure about pin 37, thereby permitting pin 44 and shaft 13 to move vertically. The high mechanical advantage offered by this type of swinging toggle linkage is greatest for the position shown in FIG. 6B where shaft 13 has reached the upper limit of its travel and arms 19 are vertically positioned. This is also the position in which maximum force is required for the various operations on the shell being processed. The mechanical advantage is greatest at this point because in this position, a given angular rotation of lever arm 38 about pin 42 produces the smallest increment of vertical motion for shaft 13, such vertical motion approaching zero as pin 44 approaches horizontal motion.

All but one of the reloading operations are performed at the uppermost position of the shell platform 14 as the shells carried by platform 14 are forced against the various tools 36 supported by stationary platform 16. The one exception is the seating of the new primer which is accomplished at the fully downward position of platform 14.

Figure 5A:
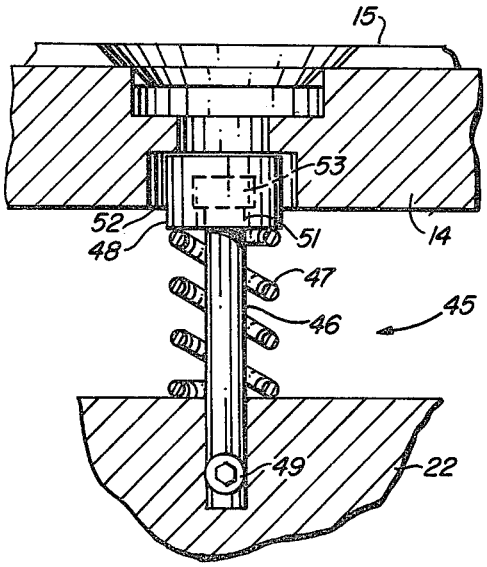
FIGS. 5A and 5B are enlarged perspective views of the tool and mechanism employed in the priming operation.
Figure 5B:
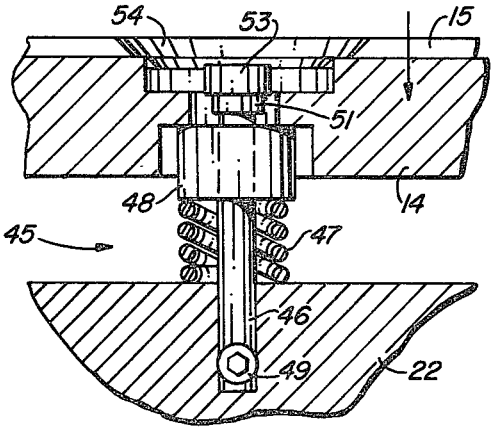

FIGS. 5A and 5B show a primer cap seating mechanism 45 comprising a stationary vertical shaft 46, a compression spring 47, and a retainer cup 48. Shaft 46 extends vertically upwardly from the top surface of support plate 22 at a position that is aligned vertically with one of the four positions of shell plate 15. The lower end of shaft 46 is seated in a hole in plate 22 and is secured therein by a lock screw 49. The upper end of shaft 46 has an enlarged section that serves as a ram 51 and as a retaining shoulder for the cup 48. Shaft 46 extends downwardly through a centered hole in the bottom of cup 48 that is too small to permit passage of ram 51. Spring 47 surrounds shaft 46 with its ends confined between the bottom of cup 48 and the juxtapositioned surface of support plate 22.

In FIG. 5A, platform 14 has moved downwardly just far enough so that cup 48 enters a depression 52 in platform 14 directly under the position of the shell carried by platform 14 that is to receive a primer cap. Cup 48 is biased upwardly by spring 47 with shaft 46 withdrawn to permit cup 48 to hold primer cap 53.

In FIG. 5B, platform 14 has been lowered to its lower limit. Cup 48 has been forced downwardly compressing spring 47 with primer cap 53 being seated in the base of shell 54.

In the utilization of the improved shell reloading machine 10, a spent shell is first loaded into the machine at position #1. The operating lever 21 is then lowered to raise platform 14 and a shell in this first position is driven upwardly into tool 36 to perform a first machine operation which might include die for sizing of the shell and removal of its spent cap. As lever 21 is subsequently lowered, a new primer cap is seated as described earlier.

The primer tool 45 is then withdrawn and shell plate 15 is advanced manually, carrying the first shell to position #2 as identified in FIG. 3.

A second shell is inserted at position #1 and lever 21 is operated a second time to perform the sizing and priming operations on the second shell while the first shell is loaded with powder at position #2.

The shell plate 15 is then manually advanced again to move the first shell to position #3 and the second shell to position #2.

A third shell is inserted at position #1 and lever 21 is operated again to size and prime the third shell while loading powder into the second shell at position #2 and at the time seating a bullet in the first shell at position #3.

Shell plate 15 is then again advanced manually to move the first shell to position #4, the second shell to position #3 and the third shell to position #2. A fourth shell is inserted at position #1 and lever 21 is operated again, this time sizing and priming at position #1, loading powder at position #2, seating a bullet at position #3 and crimping at position #4.

The plate is then advanced manually once more, moving the first shell once more to position #1. The reloaded shell is then removed from position #1 and is replaced by a fifth spent shell. After each succeeding operation of lever 21, a reloaded shell is removed from position #1 and is replaced by another spent shell. Additional manual operations required include depression of a button 55 on the powder reloading magazine 17 which causes a measured amount of powder to be loaded into the shell. The bullet is also positioned manually prior to its seating.

The special construction of machine 10 and in particular, the arrangement whereby the shell platform is carried upwardly by shaft 13 toward a fixed tool platform, results in a significant reduction in cost relative to the cost of other machines of comparable functionality. Such other machines typically utilize a stationary shell platform with a moving tool platform that is drawn downwardly toward the shell platform. The tool platform is drawn by a shaft that passes through the center of the shell platform and through the shell plate as well.

When the shaft is passed through the shell platform and through the shell plate, these elements become quite expensive because of their added size and complexity. Because the shell plate must be machined from air hardened tool steel, the cost of the large plates employed in such other machines is very significant and is multiplied by the number of individual plates required to accommodate the various shell sizes.

In the case of the improved shell reloading machine of the present invention, the shell platform and the shell plate are much smaller and can be manufacted at significantly lower cost. Furthermore, the smaller dimensions of the shell platform and of the shell plate permit a reduction in the size of the supporting framework. A very significant reduction in the total equipment cost is thus achieved in accordance with a major object of the invention.

As shown in FIG. 7, the frame 11 and base 12 for supporting the shell reloading machine 10 may be easily mounted on a table or bench for ease in operation at the right elevation or machine 10 may be directly bolted to a suitable table or bench.

Although but a single embodiment of the invention has been illustrated and described, it will be apparent to those skilled in the art that various changes and modifications may be made therein without departing from the spirit of the invention or from the scope of the appended claims.

I claim:

1. A shell reloading machine comprising in combination:

a frame, a revolubly mounted shell registering plate adapted to carry a plurality of shells, a support mounted on and arranged to extend above said frame and said plate, a plurality of tools mounted on said support, one at each of a plurality of work stations for preparing and reloading shells depending from said plate and arranged in a circle so as to register with a plurality of shells held by said plate, said tools sequentially comprising at each of said work stations a sizing die for reshaping the shells' outer wall and dislodging the spent primer from a primer cavity in the shell, primer insertion tool for inserting a new primer in the primer cavity of the shell, a powder dispenser and a bullet positioner and securing element, a drive cylinder comprising piston means mounted below said plate, said piston means being connected to said plate for moving shells mounted thereon into engagement with said tools, said plate being revolubly mounted on said piston means, and a lever arm pivotally mounted on said frame and connected at one end to said piston means for moving said plate toward and away from said tools to simultaneously execute various operations on the shells, said lever arm comprising an operating arm and a linkage, said linkage being pivotally connected at one end to said frame and at the other end to said operating arm, whereby pivotal movement of said operating arm causes relative movement of said piston means.

2. The shell reloading machine set forth in claim 1 wherein:

said linkage and piston means are in substantially vertical positions when various operations on the shells are being performed.

3. The shell reloading machine set forth in claim 2 wherein:

said operating arm is in a predetermined angular position relative to said linkage when said linkage is in a vertical position.

4. The shell reloading machine set forth in claim 1 wherein:

said lever arm comprises a pair of linkages each pivotally mounted at one end to said frame on different sides of said drive cylinder and to said operating arm on opposite sides thereof, said operating arm being connected to said piston means at a point spaced from the point of connection of said linkages thereto.

5. The shell reloading machine set forth in claim 4 wherein:

said linkages are pivotally connected to operating arm at a point closer to the operator than the point of connection of said operating arm to said piston means.

6. The shell reloading machine set forth in claim 1 wherein:

said plate is provided with a ridge extending upwardly therefrom and around its periphery, said ridge defining a plurality of openings therein with each opening arranged for receiving and holding a shell on said plate, and means mounted on said plate in at least one of said openings for holding and positioning the shell in a predetermined position in said opening.

7. The shell reloading machine set forth in claim 6 wherein:

said means comprises a button slidably mounted in an aperture in said plate and positioned in the associated opening.

* * * * *